United States Patent [19]

Northington

[11] Patent Number: 4,802,595

[45] Date of Patent: Feb. 7, 1989

[54] DEBRIS RECEIVING TROUGH

[76] Inventor: Bengie Northington, 14643 Almanac Dr., Burtonsville, Md. 20866

[21] Appl. No.: 93,224

[22] Filed: Sep. 4, 1987

[51] Int. Cl.[4] ..... A47F 5/00

[52] U.S. Cl. ..... 211/88; 211/175; 108/26

[58] Field of Search ..... 211/88, 86, 175, 126; 108/25, 26, 28; 312/229, 231

[56] References Cited

U.S. PATENT DOCUMENTS

| | | | |
|---|---|---|---|
| 506,530 | 10/1893 | McGrady | 211/88 X |
| 581,681 | 4/1897 | Shauer | 211/88 |
| 2,600,096 | 6/1952 | Cooper et al. | 211/175 X |
| 2,637,918 | 5/1953 | Mayhew | 108/26 X |
| 2,770,513 | 11/1956 | Brown | 108/27 UX |
| 4,099,470 | 7/1978 | Cannon | 108/26 |
| 4,155,310 | 5/1979 | Gregory | 108/26 |
| 4,250,396 | 2/1981 | Moeller | 312/231 X |
| 4,716,840 | 1/1988 | Tringali et al. | 108/27 |

*Primary Examiner*—Robert W. Gibson, Jr.
*Attorney, Agent, or Firm*—Frank L. Abbott

[57] ABSTRACT

A trough for attachment to the edge of a draftsman's table to receive debris such as that generated by erasures, etc. The trough is adjustable in length, supported by brackets and readily removable from the brackets so the debris may be emptied into a waste receptacle.

8 Claims, 3 Drawing Sheets

DEBRIS RECEIVING TROUGH

BACKGROUND OF INVENTION

A draftsman normally works at a table which in the course of the work becomes littered with debris such as that which accumulates when pencil points break, erasures are made, etc. It has been the practice heretofore to brush such debris onto the floor. In the course of a day the debris on the floor not only presents an unattractive appearance but to the occupants of the room constitutes a hazard which may result in injuries from falls. The debris on the floor also increases the cost of cleaning and when being walked upon can damage the floor and can be tracked into other portions of the building.

The waste receiving trough disclosed and claimed herein is novel in its concept and especially constructed to receive waste and readily removable to facilitate dumping the waste into a trash receiving receptacle.

U.S. Pat. Nos. 4,250,396; 2,810,618; 4,456,286; 4,036,369; 3,479,103; and 4,094,257 appear exemplary of the prior art devices.

U.S. Pat. No. 4,250,396 discloses an unnumbered tray at the edge of a drafting table and includes no written description thereof. The tray in the operative position of the table appears incapable of holding or retaining anything.

U.S. Pat. No. 2,810,618 discloses a tray 70 which is adapted to hold brushes, paints, etc. and appears to be permanently secured to a panel by rivets.

U.S. Pat. No. 4,094,257 discloses a box 24 which is defined by elements which are integral portions of a folding stand. The end portions 27 of the tray extend above the surface to prevent a palette from sliding. The box is designed to hold brushes, paints, etc.

U.S. Pat. No. 4,456,286 shows a ledge 70 to which serves as a container for markers and when a presentation board is in use it appears sheets C overlie the ledge 70.

Extensible shelves are shown to be old in U.S. Pat. No. 4,036,369, however, this shelf is for spice jars, etc. and is supported by brackets on a vertical shelf.

U.S. Pat. No. 3,479,103 discloses a cabinet having a narrow tray member 29 and pencil holding tray 42.

SUMMARY OF THE INVENTION

In summary the present invention defines an extensible trough adapted to be attached to the edge of a draftsman's table and readily separable therefrom. The extensibility adapting the trough to be adjusted in length to subtend a portion or the entire length of the edge of the table and having means for preventing the debris from the draftsman's efforts to be brushed onto the floor.

Among the objects are: facilitating disposal of the debris; eliminating smears and irregular lines in the drawing caused by debris on the table; also eliminating the untidiness of the table surface; and eliminating the untidiness of the floor with attendant hazards and undue wear to the floor or floor surfacing.

BRIEF DESCRIPTION OF THE DRAWING

Further objects and advantages of the invention will become apparent from the following description and claims, and from the accompanying drawings, wherein:

DETAILED DESCRIPTION OF THE PREFERRED EMBODIMENT

Figure 1:
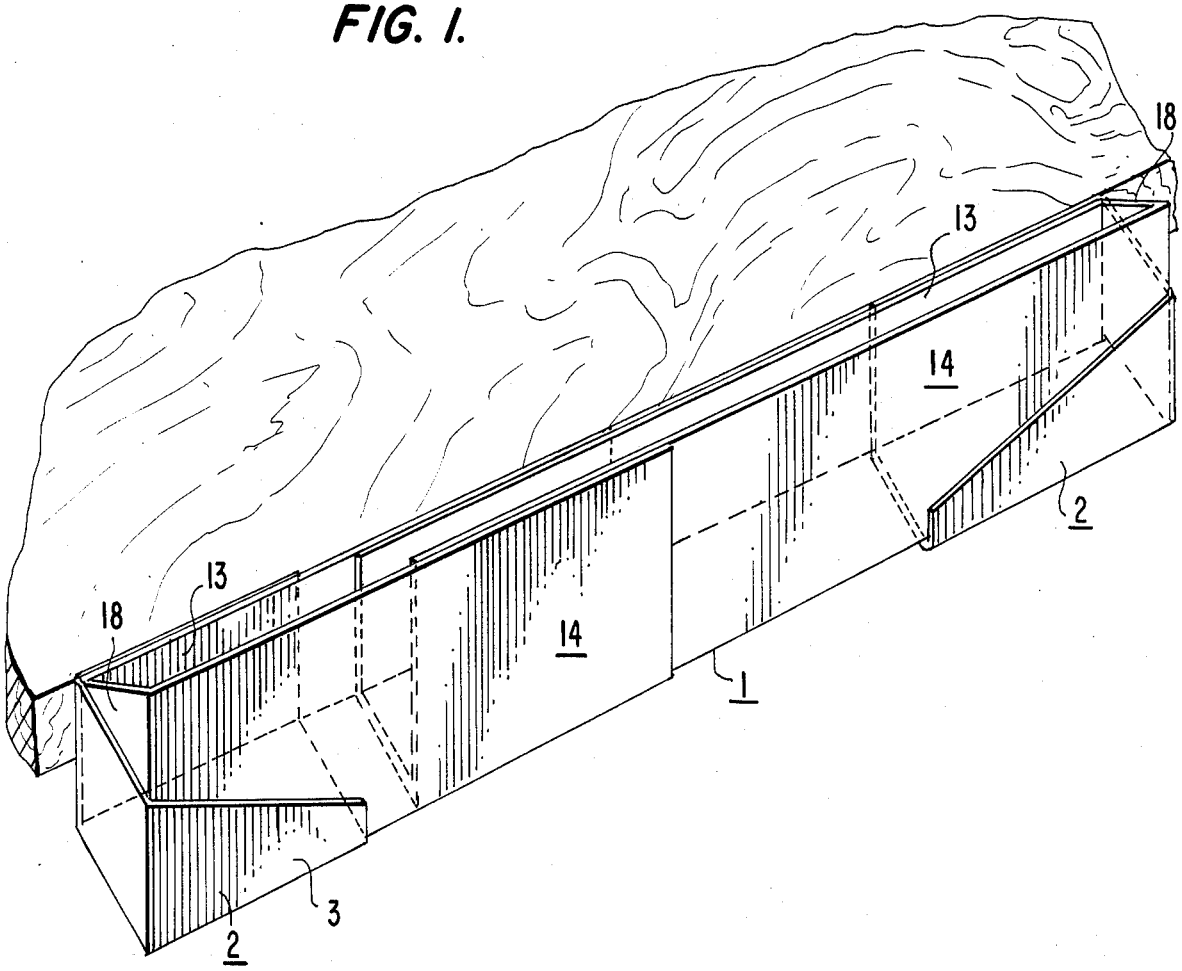
FIG. 1 illustrates an adjustable trough or receptacle supported on the edge of drafting table.

The preferred embodiment of the invention is illustrated in FIG. 1 in combination with a drafting table.

The trough 1 may be constructed from a sturdy plastic, sheet metal or any suitable lightweight material which is relatively inexpensive, has the necessary strength and can be fabricated by molding or known cutting and shaping processes.

The trough 1 is comprised of two interfitting channel members 11 and 12 each of the channel members having a back wall 13, a front wall 14 and a bottom wall 15. The channel 11 fits snugly within channel 12 and the channels are slidable relative to each other so that their combined lengths may be adjusted to the width of a drafting table or any length the user may desire for his particular application.

Figure 2:
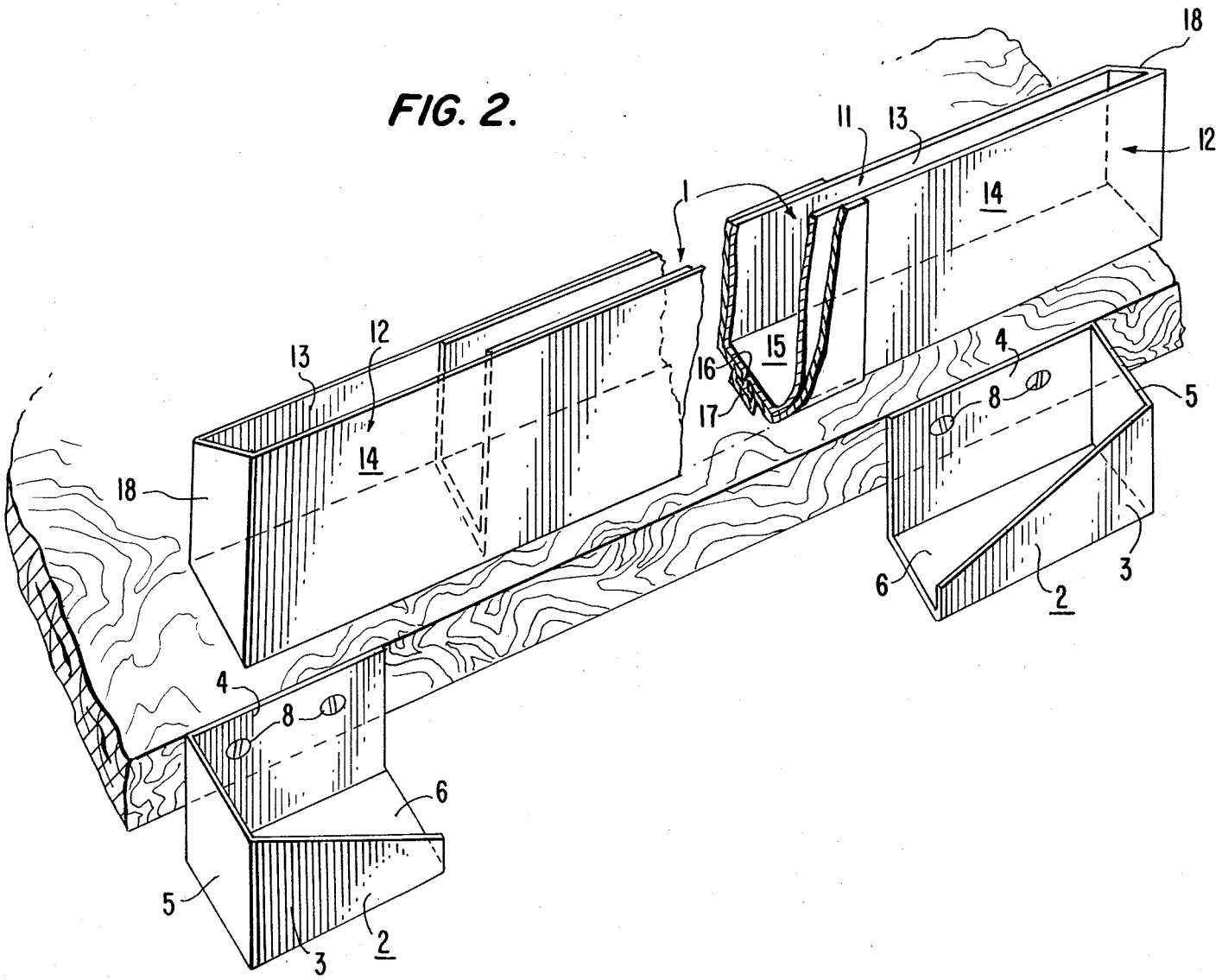
FIG. 2 is an exploded view showing some of the parts in section.
Figure 3:
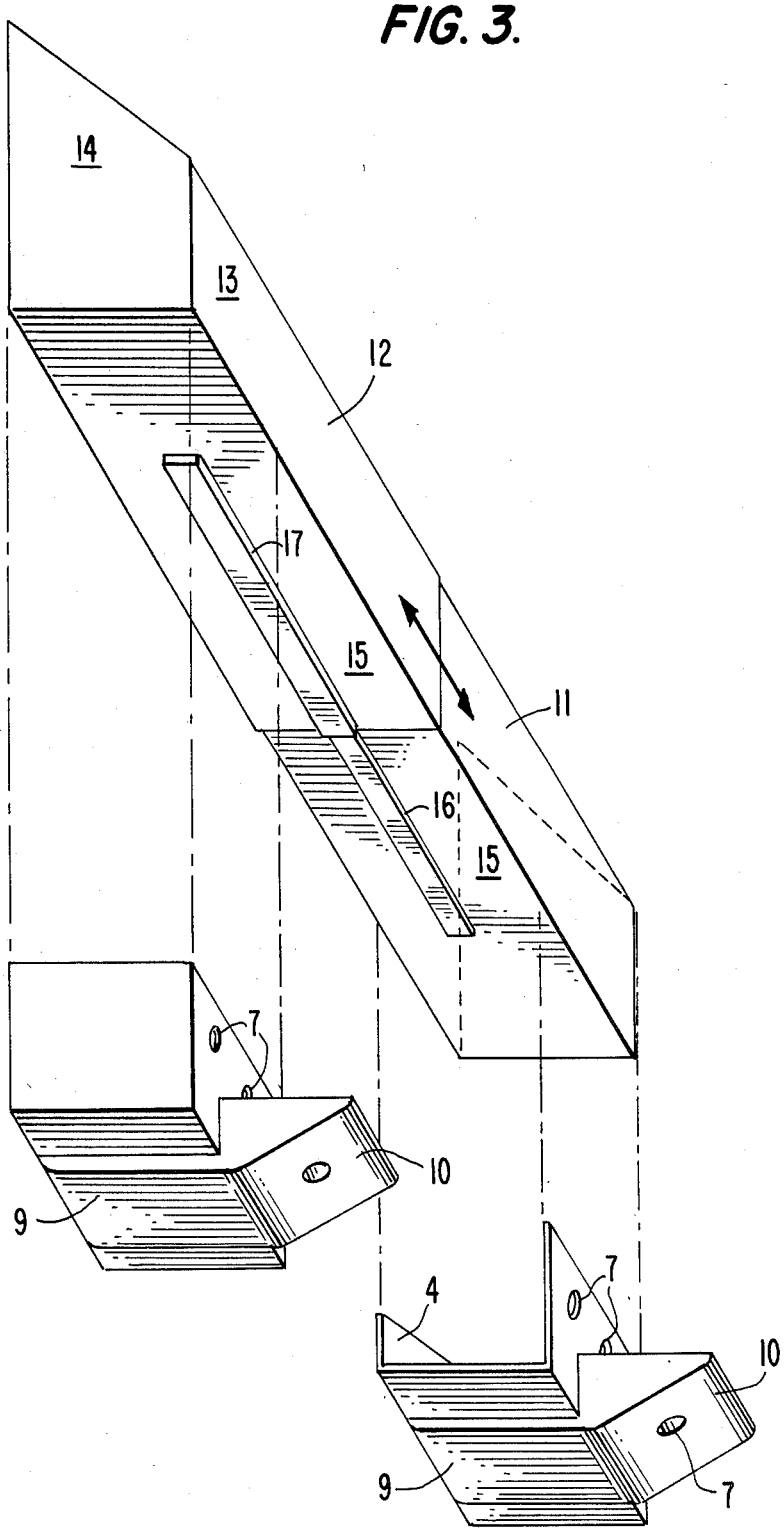
FIG. 3 is an exploded view of the trough and brackets showing additional details of both brackets and trough.

As shown in FIGS. 2 and 3 the channel 11 has a tongue 16 which reinforces the bottom wall of the channel and is slideably received in a groove 17 which reinforces the bottom wall 15 of the channel 12. The interfitting tongue and groove serve to guide the longitudinal adjustment of the channels, to maintain the channels in aligned relationship, to provide lateral stability for the interfitted channels in adjusted position and to reinforce and lend rigidity to the structure in assembled relationship especially when their length is extended to substantially its full range.

It has been the practice of drafting professionals to brush the debris accumulated as a result of their work onto the floor. This creates a hazardous floor condition, leads to damaged floors and increases the time and cost of cleaning and maintaining the floors. To eliminate the aforesaid conditions the channels 11 and 12 have front walls 14 extended a substantial distance above the back walls 13 whereby the draftsman may brush the debris from the table into the trough and the extended portions of the walls 14 will prevent flying particles of debris from going onto the floor.

By the use of this device, a long felt need in the art is met and the draftsman may maintain a clean work surface thereby eliminating the chance of irregular lines, smears and smudges on the material being worked upon and at the same time eliminating dirty, hazardous and unsightly working conditions.

The trough 1 is adjusted to the desired length and mounted and supported on the brackets 2. The brackets 2 are mounted on the edge of the table adjacent to where the draftsman sits or stands to work and near or adjacent the side edges of the table. The brackets 2 comprise front walls 3, back walls 4, end walls 5 and bottom walls 6, thereby forming a pocket open at the top and the end facing the other bracket 2. The pocket removably receiving the end of the trough 1 with the ends 18, walls 13 and 14 and bottoms 15 in engagement with corresponding parts of the spaced apart brackets. The brackets having first been secured to the edge of the table by screws 7 extended through the openings 8 into the table edge. The upper edge of the back wall 13 being flush with the plane of the table work surface and the upper edge of the wall 14 being a substantial distance above said plane, whereby when the draftsman brushes off the table or material surface the debris will be received in trough 1 and the extended portion of wall 14 will deflect flying particles into the trough. When deemed necessary the trough may be easily lifted out of the brackets and emptied into a trash receptacle.

It is pointed out that the brackets in FIG. 3 have a tongue 10 for underlying the bottom surface of the table top and a hole 7 for receiving a screw to help secure the bracket to the table and a reinforcing rib like member 9 underlying the bottom of the bracket member to reinforce said bottom; the rear wall of the bracket also has openings 7 there through to receive fastening means.

Figure 5:
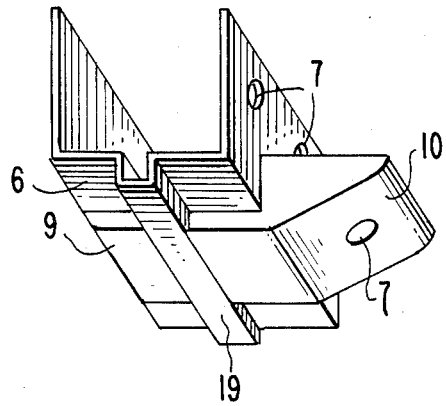
FIG. 5 is a sectional view of the bracket illustrated in FIG. 4.
Figure 4:
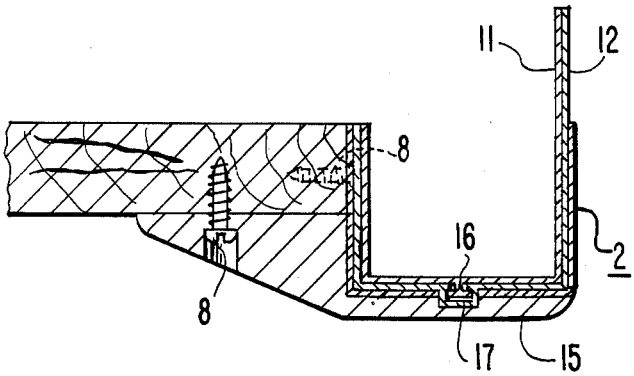
FIG. 4 illustrates a sectional view of a portion of the table, trough and a second embodiment of a bracket.

An additional embodiment of the bracket is illustrated in FIGS. 4 and 5. In this embodiment the bracket has no end walls and the bottom 6 has a groove 19 therein whereby when supporting the trough intermediate the end thereof the tongue and groove,: projecting below the bottom of the trough are received therein.

Since various modifications within the spirit of the invention may occur to those skilled in the art, it is intended that no limitation be placed on the invention except as defined by the scope of the appended claims.

I claim:

1. A trough, means for attaching the trough to and supporting it from edge of a drafting table and means for extending the length of the trough comprising interfitting channel members, a rib formed integrally with the bottom of one said channel member and a grove on another of said members slidably receiving said rib whereby the channel members may be moved relative to each other to vary the overall length of the trough and the rib and groove guide their relative motion, reinforce the members and lend lateral stability to the trough.

2. The structure of claim 1 in which the means for attaching and supporting the trough comprises a plurality of brackets, each bracket having an end wall, a back wall, a front wall and a bottom defining a pocket in which an end of the trough is received.

3. The structure of claim 2 in which the bottom of at least one of said brackets has a tongue adapted to be attached to the underside of a drafting table.

4. The structure of claim 1 in which the means for attaching the trough to and supporting it from a drafting table comprises a plurality of brackets each of said brackets having a bottom, the bottom of some of said brackets having having a groove defined therein for receiving said rib and groove projecting from the bottom of said trough.

5. A trough adjustable in length comprising interfitted channel members, each having a back wall adapted to be mounted against the edge of a table, a bottom wall, and means on the bottom wall interfitted with mating means on the contiguous bottom wall of the other channel member to guide the axial adjustment of said channels and provide lateral stability to the trough, and a front wall spaced from said back wall having an extension which extends above the plane in which the top of the back wall lies, said extension preventing objects brushed from the table over flying the trough and means for attaching the trough to a table.

6. The trough defined in claim 5 in which the means for attaching said trough to a table comprises brackets adapted to be spaced along the length of the trough and means for securing said brackets to a table.

7. The structure of claim 5 in which said trough is open at its ends and the means for attaching the trough to a table comprises a plurality of brackets, at least two of which are positioned at the ends of the trough and include means for closing the respective ends of the trough.

8. The structure of claim 7 in which each of the brackets adapted to be positioned at the open ends of the trough comprises an end wall adapted to close the respective end of the trough, a back wall, a front wall and a bottom, said walls and bottom defining a pocket for receiving the end of a trough.

* * * * *